United States Patent [19]

Radomsky

[11] Patent Number: 4,868,999

[45] Date of Patent: Sep. 26, 1989

[54] APPARATUS AND METHOD FOR PRODUCTION OF ASPHALT PAVEMENT HAVING HIGH RECYCLED ASPHALT CONTENT

[75] Inventor: John Radomsky, Cedar Park, Tex.

[73] Assignee: C.D. High Technology, Georgetown, Tex.

[21] Appl. No.: 96,899

[22] Filed: Sep. 15, 1987

Related U.S. Application Data

[63] Continuation-in-part of Ser. No. 28,581, Mar. 20, 1987.

[51] Int. Cl.[4] ..... F26B 11/02

[52] U.S. Cl. ..... 34/127; 34/131; 366/235

[58] Field of Search ..... 34/127, 130, 131, 132, 34/133, 136, 137, 22, 155; 366/4, 7, 22, 24, 25, 14, 235

[56] References Cited

U.S. PATENT DOCUMENTS

| | | | |
|---|---|---|---|
| 2,415,738 | 2/1947 | Freund . | |
| 2,673,403 | 3/1954 | Fagioli . | |
| 3,060,589 | 10/1962 | Wallin . | |
| 3,060,595 | 10/1962 | Dapses . | |
| 3,089,253 | 4/1963 | Evans . | |
| 3,111,453 | 11/1963 | Helversen . | |
| 3,151,955 | 10/1964 | Fleissner . | |
| 3,158,448 | 11/1964 | Wallin et al. . | |
| 3,391,472 | 7/1968 | Landers . | |
| 3,398,467 | 8/1968 | Brown . | |
| 3,525,164 | 8/1970 | Brown . | |
| 3,999,743 | 12/1976 | Mendenhall . | |
| 4,096,588 | 6/1978 | Mendenhall . | |
| 4,190,370 | 2/1980 | Brock et al. . | |
| 4,387,996 | 6/1983 | Mendenhall | 366/4 |
| 4,481,039 | 11/1984 | Mendenhall . | |
| 4,538,364 | 9/1985 | Jensen . | |
| 4,561,194 | 12/1985 | Sutch . | |
| 4,705,404 | 11/1987 | Bruggemann | 366/14 X |

*Primary Examiner*—Henry A. Bennet

*Attorney, Agent, or Firm*—Ronald R. Snider

[57] ABSTRACT

An apparatus and method for manufacture of asphaltic pavement from recycled asphalt pavement (RAP) and virgin rock and asphaltic materials is shown and described. This method utilizes efficient and controlled heat from a recirculating air impingement air dryer for heating of the RAP to a first temperature prior to the RAP being mixed with high temperature rock which is supplied from a rotating drum heater. The mixture of rock and RAP may comprise as much as 80% RAP because the RAP is preheated piror to the RAP rock mixing step.

8 Claims, 1 Drawing Sheet

APPARATUS AND METHOD FOR PRODUCTION OF ASPHALT PAVEMENT HAVING HIGH RECYCLED ASPHALT CONTENT

This application is a continuation-in-part of my copending application entitled: Method And Apparatus For Treating Asphaltic Concrete Paving Materials, Ser. No. 028,581, filed Mar. 20, 1987. This copending application is also incorporated by reference into this application.

BACKGROUND OF THE INVENTION

In the aforesaid copending application, there is shown and described a recirculating air impingement heater-dryer which is utilized for heating of recycled asphalt pavement (RAP). In this device air at a high velocity is inserted into the layer of RAP on top of a conveyor belt which passes beneath air impingement tubes. The high velocity air removes water from the surface of the RAP by causing rapid evaporation of the moisture. The high velocity air also forms wind row lines of RAP on the conveyor belt. The creation of the wind rows is provided by the high velocity air, and exposes different surfaces of the RAP as the material is moved back and forth from row to row by the use of the tubes. It has been found that this is an extremely efficient method for removing water vapor from RAP and for heating it.

The dryer also includes a recirculating feature which permits air to be recirculated within the dryer, and new air added as oxygen is required by the burners. Old air and moisture are removed from the recirculating gases as new oxygen and heat is required by the system.

In the art of recycling asphaltic pavement, it has been found that a process whereby new virgin rock is mixed with old asphaltic pavement is desirable. In this process, the rock may be heated to a temperature in excess of 600° F. and then the rock may be mixed with RAP. The high heat of the rock combines with the low heat of the RAP to produce a uniform asphaltic mixture which as a temperature which is a function of the average heat count of the RAP and the rock. In this method utilizing RAP at plant operating site temperatures and virgin rock at 600° F. or more, it has been found that the RAP of the final mixture cannot exceed approximately 40%. This limitation is undesirable because it is often desirable to have a much higher percentage RAP content, so that there will not be any excess RAP when the recycling and paving operations are complete.

In U.S. Pat. No. 4,481,039 Mendenhall there is shown an apparatus for heating both RAP and virgin rock in a single rotating drum which includes a burner 40. The drum receives RAP from conveyor 26 through chute 16 and heats it in a cold section 28 of the drum. Virgin rock may also be added at hopper 30 and heated in the hot end of the drum 12. The hot rock from hot end 12 is deposited on conveyor 55 and may also be added to the virgin RAP being added to the cold end of the drum from conveyor 26. The final product which is a mixture of RAP and preheated virgin rock is then removed from the process by a conveyor 60. In this system the RAP is heated primarily by the addition of hot rock at hopper 26, and also by the flame from burner 40 which exhausts at pipe 22. By this process, the temperature of the virgin RAP is raised by the heat from the gases of burner 40 as well as the heat contained in the stone which is removed from the drum at conveyor 44.

Mendenhall also provides for a separate return path of hot rock 55 to conveyor 35 which provides for temperature control of the rock heating section of the drum because of the feedback of heated material.

U.S. Pat. No. 3,999,743 Mendenhall shows another rotating drum apparatus which receives three different grades of asphaltic particles or rock for the purpose of providing different heating rates to different aggregate sizes.

U.S. Pat. No. 4,095,284 Mendenhall also shows a mixing device which heats different aggregate sizes for different times and rates in order to achieve uniform heating throughout.

SUMMARY OF THE INVENTION

This invention utilizes separate RAP and virgin rock heating devices. The device for heating the rock is a rotating drum heater which is capable of heating the rock to a temperature of 600° F. or greater. The rock may be transported to the rotating drum and from the rotating drum by means of a conveyor belt.

The RAP is heated separately in an independent recirculating air impingement dryer where the RAP temperature can be raised to a level which is only slightly less than the temperature at which smoking occurs. Smoking is undesirable in asphaltic heating because of the detrimental effect on the environment, and because of the deterioration of the asphaltic materials which occurs with burning or smoking.

The RAP and heated rock are then merged together in a third location which is a mixing drum. In this drum, the 600° F. plus rock is mixed with the RAP at a temperature of approximately 225° C. In this mixing operation, the RAP and rock together will then achieve a uniform temperature in the order of 300°-350° F.

The process of preheating the RAP prior to mixing with the high temperature virgin rock permits a greater percentage of RAP to be used than is obtainable where cold RAP is mixed directly with hot virgin rock. The additional heat added to the RAP permits use of a greater percentage of RAP in the final asphaltic mixture.

The air impingement recirculating air dryer also provides for an extremely efficient and controlled manner of heating the RAP. The use of a separate drum for the virgin rock, a separate recirculating air dyer for the RAP, and the merging of the streams together into a mixing area permits controlled heating of the RAP at the maximum possible efficiency, as well as, controlled heating of the virgin rock. The heating of the RAP with a recirculating air dryer and conveyor belt also permits heating of the RAP to temperatures where the RAP may become tacky. In the conveyor system, the RAP may still be transported to the point where it can be mixed with the hot asphaltic rock. In contrast, in heating a RAP in rotating drums to the point where the RAP becomes tacky, great difficulties are encountered. The tacky RAP tends to stick to the sides of the drum, stick to the blades of the drum, and to combine with itself in order to form a lump of tacky RAP rolling within the drum. The recirculating air dryer therefore permits heating of the RAP to temperatures which are in the tacky range, and greater than those which are achievable by rotating drums.

DETAILED DESCRIPTION OF THE PREFERRED EMBODIMENT

Figure 1:
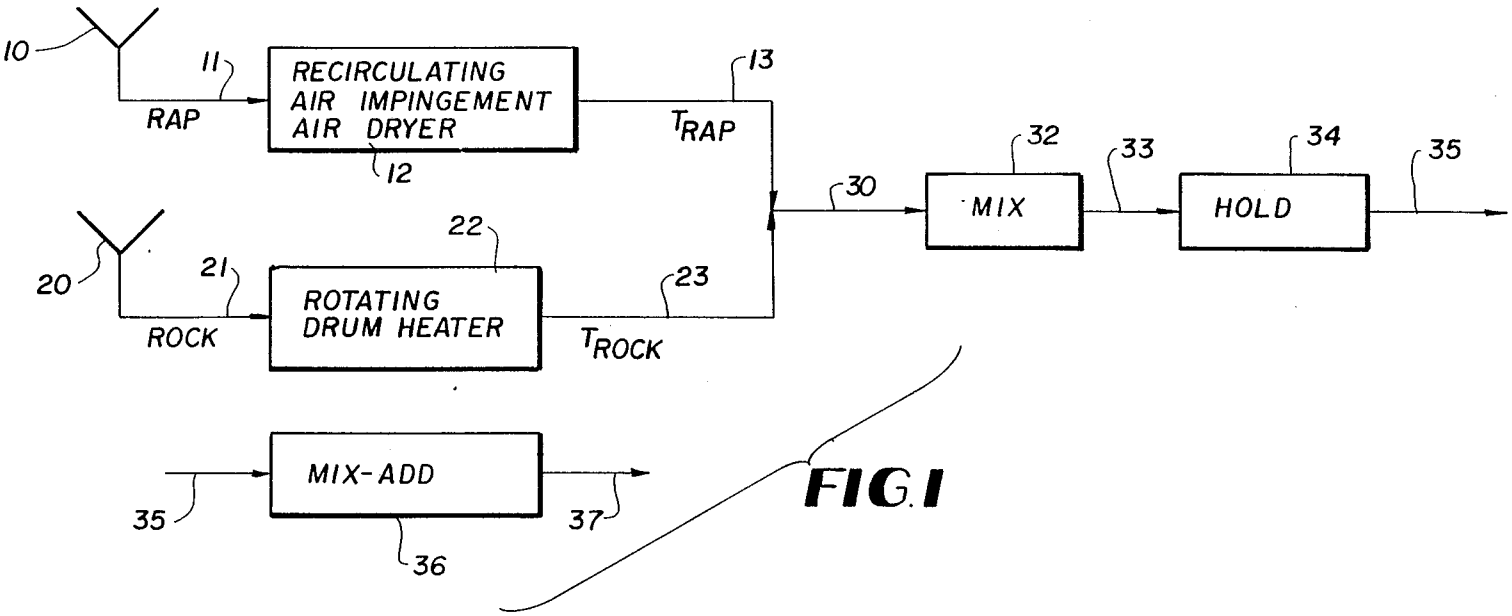
FIG. 1 shows in diagrammatic form the apparatus and process for producing asphalt having a high recycled asphalt content.

As shown in FIG. 1, RAP is introduced into a hopper 10 and then moves along a conveyor 11 to the recirculating air impingement air dryer 12. After the RAP has been heated in the air dryer, it then passes along conveyor 13 to conveyor 30. Also shown is placement of virgin rock in hopper 20 which then feeds the rock to a conveyor 21. The conveyor 21 introduces rock into the rotating drum heater 22 which heats the rock to a temperature in excess of 600° F. The heated rock then passes across conveyor 23 to conveyor 30 and into the mixing station. The temperature of the RAP and rock at conveyors 11 and 21 respectively is at normal ambient temperature. The recirculating air impingement air dryer raises the temperature of the RAP to approximately 225° which should be below the temperature where smoking is produced in the RAP being heated. The temperature of the RAP as it exits the air dryer on conveyor 13 may be between 150° and 300° F. depending upon the characteristics of the asphalt in the RAP. The temperature of the rock exiting the rotating drum heater 22 is preferably 600° F., but may range from a low of 350° F. to temperatures well in excess of 600°.

The warm RAP from conveyor 13 and the hot rock from conveyor 23 are then combined at conveyor 30 and fed to a mixing drum 32 which thoroughly mixes the RAP and the rock. After mixing, the RAP and the rock are then fed by conveyor 33 to a holding area 34 which provides sufficient time for the rock and the RAP to reach a uniform temperature throughout. The mixture of RAP and rock is then fed from holding area 34 to a conveyor 35 which moves the material to a mixing and adding location 36. This mixing and adding location may be a pug mill or other suitable mill for stirring and mixing the RAP and rock while applying additional asphaltic compound to bring the entire mixture up to road specifications. The completed mixture of rock, RAP, and rejuvenating asphaltic compounds is then fed out at conveyor 37 and is ready for application to a roadbed.

The heating of the RAP by the recirculating air impingement air dryer 12, the RAP may be heated to a temperature of at least 150° F., and may be heated to any temperature above this where no smoking or degradation of the RAP is experienced.

By this method and apparatus, the percentage of RAP in the final mixture may be increased to levels of from 50 to 80%. This use of higher percentages of RAP permits the complete consumption of RAP which is generated at a rod repair location. The elimination of excess RAP permits more efficient recycling because the RAP may be placed back on the highway, rather than being dumped at some further remote location. The high RAP percentage in accordance with this invention is achieved by efficient controlled heating of the RAP prior to mixing with the heated virgin rock.

The heating of the virgin rock in the drum may be rapid because flame and high heat can be applied directly to the rock. In such rapid heating of the rock, the exterior of the rock may be heated much more rapidly than the interior, and hence may momentarily achieve temperatures substantially in excess of the mass average temperature. The mass average temperature is the temperature of the mass of rock when the temperature becomes uniform.

Figure 2:
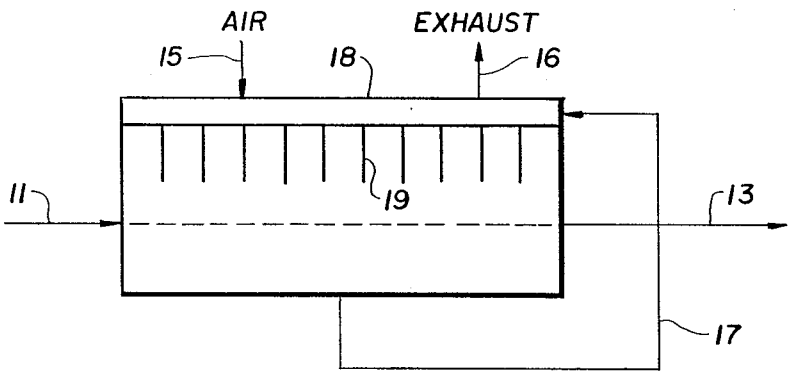
FIG. 2 shows in diagrammatic form a recirculating air dryer including tubes for applying high velocity air to RAP passing beneath them on a conveyor belt.

In FIG. 2 there is shown a recirculating air impingement dryer. This application incorporates by reference the disclosure of U.S. patent application Ser. No. 028,581, filed Mar. 20, 1987, Attorney Docket No. P-1825-19700, entitled: Method And Apparatus For Treating Asphaltic Concrete Paving Materials which describes the use of a recirculating air impingement air dryer for the use of treatment of asphaltic compounds. The recirculating air dryer of FIG. 2 show san air input 15 which inserts fresh air into the dryer and an exhaust 16 which removes a portion of the recirculating air and moisture from the cycle. Also shown is a connection 17 which depicts the recirculation of the air from the bottom of the air dryer back to the air dryer plenum 18. A heater may be located at any point in the cycle, and it should supply warm air to the plenum 18 so that it can be injected into the tubes 19 which provide the 100 mile per hour high velocity air which strikes the RAP and dries it by air impingement.

While the invention has been described with respect to specific embodiments, it will be apparent that many modifications are possible and it is not intended to limit the invention except as defined in the following claims.

I claim:

1. An apparatus for producing an asphalt based pavement material from recycled asphaltic pavement (RAP) and virgin aggregate comprising in combination:

a first high temperature rotating drum heater for heating said virgin rock to a temperature greater than 350° F.;

a second low temperature air impingement air dryer heater for heating RAP to a temperature below that at which smoking of said RAP occurs;

means for continuously moving said virgin rock from said first heater and said RAP from said second heater to a means for mixing said RAP and rock.

2. The apparatus of claim 1, wherein said second low temperature heater is an air impingement recirculating air dryer.

3. The apparatus of claim 1, wherein said RAP is heated to a temperature between 150° and 200° F.

4. The apparatus of claim 1, wherein said RAP is heated to a temperature between 200° and 250° F.

5. The apparatus of claim 1, further comprising a means for holding said mixture of RAP and virgin rock until the mixture achieves a substantially uniform temperature throughout.

6. The apparatus of claim 5, further comprising means for mixing said uniform temperature mixture with additional asphaltic binding material.

7. A method in accordance with claim 1, wherein said RAP comprises at least 70% of the weight of the final mixture.

8. The apparatus in accordance with claim 1, wherein said RAP comprises at least 80% by weight of the final mixture.

* * * * *